US010681481B2

(12) United States Patent
Wolff

(10) Patent No.: US 10,681,481 B2
(45) Date of Patent: Jun. 9, 2020

(54) CONTROL UNIT FOR AUDIO SYSTEM WITH SUBWOOFER AND METHOD FOR PHASE CORRECTION

(71) Applicant: Sennheiser electronic GmbH & Co. KG, Wedemark (DE)

(72) Inventor: Markus Wolff, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 16/566,093

(22) Filed: Sep. 10, 2019

(65) Prior Publication Data

US 2020/0092667 A1 Mar. 19, 2020

(30) Foreign Application Priority Data

Sep. 13, 2018 (DE) ..... 10 2018 122 440

(51) Int. Cl.
*H04R 29/00* (2006.01)
*H04R 5/04* (2006.01)

(52) U.S. Cl.
CPC ..... *H04R 29/002* (2013.01); *H04R 5/04* (2013.01); *H04R 2420/07* (2013.01)

(58) Field of Classification Search
CPC ..... H04R 29/002; H04R 5/04; H04R 2402/07
USPC ..... 381/59
See application file for complete search history.

(56) References Cited

U.S. PATENT DOCUMENTS

2004/0258256 A1 12/2004 Ruff
2010/0220864 A1* 9/2010 Martin ..... H04S 7/307 381/1
2010/0290643 A1* 11/2010 Mihelich ..... H04S 7/301 381/99

FOREIGN PATENT DOCUMENTS

DE 39 28 122 11/1990
DE 42 24 404 1/1994

* cited by examiner

*Primary Examiner* — Quynh H Nguyen
(74) *Attorney, Agent, or Firm* — Haug Partners LLP

(57) ABSTRACT

A control unit for an audio system including a subwoofer and at least one further loudspeaker. Type information is recorded via the at least one connected loudspeaker, and a configurable filter for the at least one connected loudspeaker is configured by means of appurtenant configuration information from a memory. The configurable filter is configured so that a base phase management is provided for the transition frequency range between the subwoofer and the at least one connected loudspeaker so that the phase of the sound signals of the subwoofer is matched to the phase of the sound signals of the at least one connected loudspeaker.

15 Claims, 4 Drawing Sheets

CONTROL UNIT FOR AUDIO SYSTEM WITH SUBWOOFER AND METHOD FOR PHASE CORRECTION

The present application claims priority from German Patent Application No. 10 2018 122 440.0 filed on Sep. 13, 2018, the disclosure of which is incorporated herein by reference in its entirety.

The invention relates to a control unit for an audio system which comprises a subwoofer and at least one further loudspeaker as well as a method for phase correction of audio data which are reproduced by such an audio system.

BACKGROUND

Low-frequency loudspeaker boxes, so-called subwoofers, frequently contain an integrated bass management which includes a frequency separation between the subwoofer and other loudspeakers or loudspeaker boxes connected to the subwoofer. This can be, for example, so-called monitor boxes in the studio area which are also simply designated as monitors. Unless expressly specified otherwise, the term "loudspeaker" in this description also covers loudspeaker boxes. It is known to carry out a phase matching for the loudspeaker boxes connected to the subwoofer in order to match their phase to the phase of the subwoofer. Otherwise, i.e. if the phases are not matched, frequency-dependent delays are formed between the sound reproduced by the loudspeaker boxes and the sound reproduced by the subwoofer. In a transition frequency range in which the subwoofer and the other loudspeaker boxes deliver sound signals in comparable amplitudes, the superposition of these sound signals—it they do not match one another in their phase position—can have the result that the sound signals delivered by the subwoofer and the sound signals delivered by the other loudspeaker boxes exaggerate or partially cancel out each other in a frequency-dependent manner which has a perturbing effect in the hearing impression. The matching can be carried out by allpass filtering or delay in the range of the frequency separation between the subwoofer and the other connected loudspeaker boxes.

In addition, it is known to carry out a phase linearization of the natural phase nonlinearity in the range of the frequency separation in multiway boxes. This is achieved, for example, in two-way boxes (low-frequency/high-frequency) or three-way boxes (low/medium/high-frequency), in analogue systems by filters with an allpass component or in digitally controlled systems by FIR filters.

In this case, a low-noise implementation of phase linearization in loudspeaker boxes frequently requires a digital, i.e. DSP-based signal processing with FIR filters. A subsequent phase linearization of existing loudspeakers is only possible by adding a proprietary external electronic circuit which behaves inversely to the phase behaviour of the respective loudspeaker.

FIG. 1 shows a known analogue loudspeaker 100, in particular a two-way box with analogue signal processing. The audio data received at the input 105 are split in an audio crossover comprising a high-pass filter 110 and a low-pass filter 140 into a low-frequency and a high-frequency component which are amplified via dedicated amplifiers 120, 150 and output to corresponding loudspeakers 130, 160 suitable for the respective frequency range. In this case, the analogue high-pass filter 110 normally has a phase response in its frequency response 110*a* in which for frequencies below the corner frequency the phase is rotated by +90° (for first-order filter) whereas for frequencies above the corner frequency the phase is not rotated (i.e. 0°). On the other hand the analogue low-pass filter 140 normally has a phase response in its frequency response 140*a* in which for frequencies below the corner frequency the phase is not rotated whereas for frequencies above the corner frequency the phase is rotated by −90° (for first-order filter). In the acoustic sum the loudspeaker box with its frequency response 100*a* delivers a constant amplitude in its envisaged working range, i.e. above a lower limiting frequency. As a result of the above-mentioned phase linearization, it can also be achieved that the phase is constant above the lower corner frequency so that the loudspeaker box is designated as "phase-linear" above this frequency. At the lower limiting frequency and below, the analogue loudspeaker box 100 exhibits a similar behaviour to a high-pass filter because the phase is changed by up to +90°.

FIG. 2 shows a known digital loudspeaker 200, in particular a digitally controlled two-way box. The audio data received at the input 205 are again split into a low-frequency and a higher-frequency component in an audio crossover comprising a digital high-pass filter 210 and a digital low-pass filter 240, which components are each amplified via dedicated amplifiers 230, 260 and output to corresponding loudspeakers 230, 260 suitable for the respective frequency range. In this case, both the digital high-pass filter 210 with its frequency response 210*a* and also the digital low-pass filter 240 with its frequency response 240*a* are designed to be phase-linear. This means that both frequency responses 210*a* and 240*a* have a phase of 0° in the respective processed frequency range, wherein the phase-linear filtering however produces a delay DM1. The delay DM1 is not shown in the phase response in this analysis but is treated separately. The digital loudspeaker box 200 also has a natural lower limiting frequency. In the acoustic sum the digital loudspeaker box 200 with its frequency response 200*a* has an amplitude response like a high-frequency filter but the phase in the processed frequency range is 0° and the output is overall delayed by the delay DM1.

This difference in the behaviour of analogue and digital loudspeaker boxes close to the respective lower limiting frequencies results in problems when these are to be operated together with a subwoofer because the bass management for the subwoofer must intervene precisely in this frequency range.

In the priority-substantiating German patent application, the German Patent and Trademark Office has searched the following documents: DE 39 28 122 A1, DE 42 24 404 A1 and US 2004/0 258 256 A1.

SUMMARY OF THE INVENTION

An object of the present invention consists in providing an improved bass management for subwoofers, e.g. in the form of a control unit as well as a method for phase correction of audio signals to be reproduced via several loudspeakers. In particular, the invention allows a matched incorporation of various loudspeaker boxes into an entire system. A user can, for example, still use his existing loudspeaker boxes in the new system and thereby incorporate both loudspeaker boxes with an analogue signal processing according to FIG. 1 and also loudspeaker boxes with a digital signal processing according to FIG. 2.

According to the invention, a control unit for an audio system with subwoofers contains additional components to linearize phase responses of the loudspeakers connected to the subwoofer. In this case, the control unit can be located in the subwoofer and in particular, loudspeakers operating in a minimal-phase manner, for example, connected to the control unit or the subwoofer can be identified and equalized in a linear-phase manner. As a result of the identification and suitable equalization in each case, the control unit according to the invention allows a flexible combination of analogue and digital loudspeaker boxes with a subwoofer. This is particularly advantageous since it is possible to integrate existing loudspeaker boxes of an existing sound system into an audio system fitted according to the invention. Thus, a subsequent addition of a control unit according to the invention or a subwoofer according to the invention to an existing loudspeaker arrangements is possible, e.g. in order to extend the overall frequency response of the entire reproduction system to low frequencies or increase the maximum level at low frequencies. As a result, the performance of the connected loudspeakers can also be increased. The signal which is guided to the loudspeakers passes through the signal processing located in the control unit or in the subwoofer for processing by means of the bass management. In the course of this, phase nonlinearities are also corrected.

BRIEF DESCRIPTION OF THE DRAWINGS

Further details and advantageous embodiments are shown in the drawings. In the figures.

DETAILED DESCRIPTION OF THE INVENTION

Figure 3:
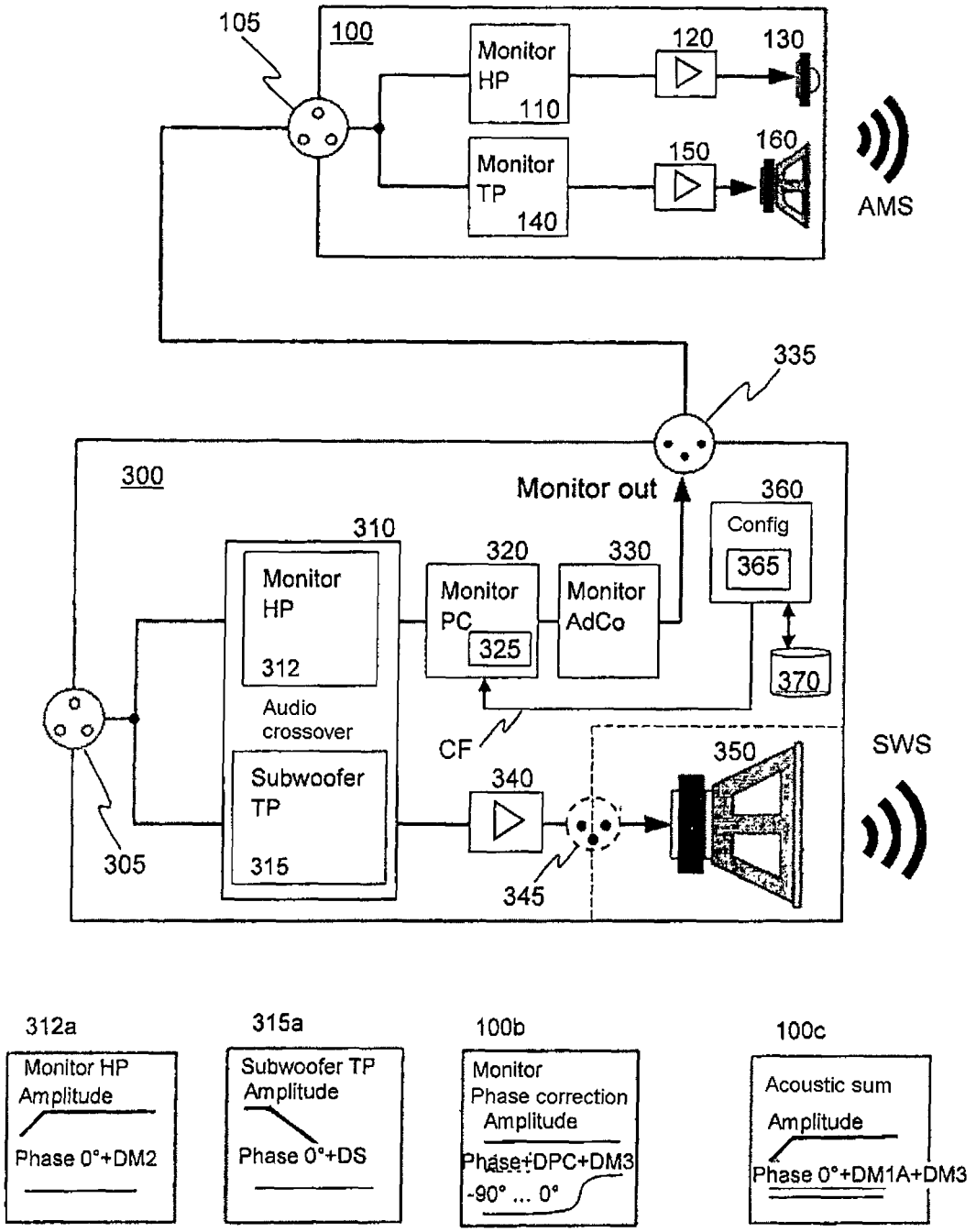
FIG. 3 shows a subwoofer according to the invention with a control unit and an analogue two-way box connected thereto.

FIG. 3 shows a subwoofer according to the invention with a control unit 300 and an analogue two-way box 100 connected thereto. The control unit 300 is suitable for an audio system which comprises at least one subwoofer or low-frequency loudspeaker 350 and at least one further loudspeaker 100, 200. In this example, the control unit 300 is integrated in the subwoofer and contains at least one input connection 305 for receiving input audio data and at least one output connection 335 for outputting audio data to the at least one further loudspeaker 100, 200. The control unit 300 furthermore contains an audio crossover 310 which splits the input audio data by means of a high-pass filter 312 into at least one high-pass component and by means of a low-pass filter 315 into a low-pass component. The low-pass component can be amplified by means of an amplifier 340 and then output by means of a connection 345 to the subwoofer or low-frequency loudspeaker 350. If the control unit 300 is integrated in the subwoofer, the connection 345 is an internal connection. The low-frequency loudspeaker 350 then delivers a corresponding low-frequency sound signal SWS. The control unit 300 additionally contains a configuration block 360, an input block 365 and a memory 370, wherein the configuration block 360 can receive type information via the input block 365 via the at least one further loudspeaker 100, 200 which is connected or can be connected via the output connection 335. The configuration block 360 can retrieve configuration corresponding to the type information from the memory 370 and process and output this. In addition, the control unit 300 contains a configurable filter 320 which can receive the configuration information CF from the configuration block 360 and can be configured according to the configuration information. The configurable filter 320 is connected to the high-pass filter 312 to receive the high-pass component of the input audio data and filter according to the configuration information CF. The audio data thereby produced can be output via the output connection 335. In the example according to FIG. 3, the filtered audio data are output to an analogue monitor box 100 which reproduces a corresponding sound signal AMS. Optionally a processing block 330 can be additionally provided between the configurable filter 320 and the output connection 335.

The digitally constructed high-pass filter 312 is designed to be phase-linear and has a frequency response 312*a*. In the processed frequency range it has a phase of 0° wherein the phase-linear filtering produces a delay DM2 which in this analysis is not shown in the phase response but is analyzed separately. Accordingly, the digitally constructed low-pass filter 315 is also designed to be phase-linear and has a frequency response 315*a*. In the processed frequency range it has a phase of 0° wherein the phase-linear filtering generates a delay DS.

Figure 1:
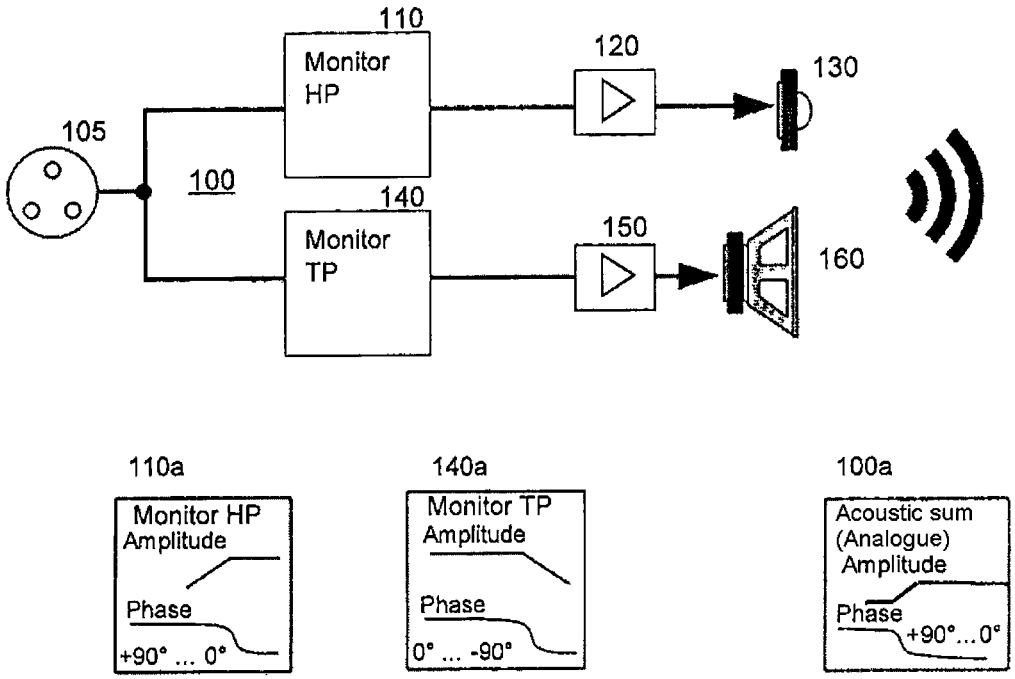
FIG. 1 shows a known analogue two-way box.

A crucial element of the invention is the configurable filter 320 which is used for phase correction of the loudspeaker connected to the output connection 335. In the example according to FIG. 3 in which a loudspeaker box 100 with an analogue signal processing according to FIG. 1 is connected to the output connection 335, the configurable filter 320 can have a frequency response 100*b*. In this case, it conducts the signal with a constant amplitude but produces a phase response in which the phase in this example has a negative value for low frequencies, possibly as far as the limiting frequency of the analogue loudspeaker box 100. The filtering in the filter 320 can in this case produce a delay DPC which is not shown in the phase response here but is again analyzed separately. In addition, an additional adjustable delay DM3 can also be added in the configurable filter 320, for example, by means of a delay member 325. The negative phase of the configurable filter 320 at low frequencies serves to compensate the phase response 100*a* of the connected loudspeaker box 100. In the series circuit of the configurable filter 320 with the loudspeaker box 100, a frequency response 100*c* is then obtained. The amplitude response here corresponds to the frequency response 100*a* but the configurable filter 320 is designed so that the series circuit has a linear phase response. In the frequency response 100*c* a phase of 0° is therefore again obtained in the processed frequency range to which a separately analyzed delay DM1A and the adjustable delay DM3 are added. The delay DM1A is obtained from the phase responses 100*a* and 100*b* and the delay DPC.

Different types of boxes have different frequency responses. In order that a linear phase is successfully produced, the configurable filter 320 must be suitably configured for the connected box in each case. The configuration data from the memory 370 are used for this purpose. In order to produce the configuration data in the memory 370, the frequency responses of the different types of loudspeaker according to magnitude and phase are measured in advance. By means of these measurements suitable configuration data can then be produced for each measured type of loudspeaker, which are each stored jointly with the type identifier in the memory 370. By means of the type information obtained via the input block 365, the configuration block 360 can thus select the suitable configuration information CF in each case and transmit it to the configurable filter 320. Optionally the configuration unit 360 which, for example, contains a processor can process the data read out from the memory 370 prior to transmission to calculate the configuration data CF in each case.

In the system described according to FIG. 3, the sound output from the subwoofer 350 and from the connected loudspeaker box 100 therefore takes place in each case with a linear phase. In order that the initially described exaggerations and cancellations in the transition frequency range do not occur in which the subwoofer and the other loudspeaker boxes deliver sound signals in comparable amplitudes, the delays must then be matched to one another.

Summarizing for FIG. 3, the high-pass filter 312 generates a delay DM2 and the series circuit comprising the configurable filter 320 and the analogue loudspeaker box 100 generates a delay DM1A as well as the adjustable delay DM3. The reproduction of the higher-frequency sound signal AMS is therefore accomplished with a delay which is composed of DM2+DM1A+DM3. The reproduction of the low-frequency sound signal SWS is accomplished via the low-frequency loudspeaker 350 with a delay DS. For correct audio reproduction of the audio system it must therefore necessarily follow that DS+DM2+DM1A+DM3. The adjustable delay can then be selected so that this equation is satisfied. Optionally when determining DM3, the positioning of the subwoofer 350 and the connected loudspeaker box 100 at the respective installation site can also be taken into account in order to take account of the respective transit time of the sound as far as a desired listening point.

Figure 2:
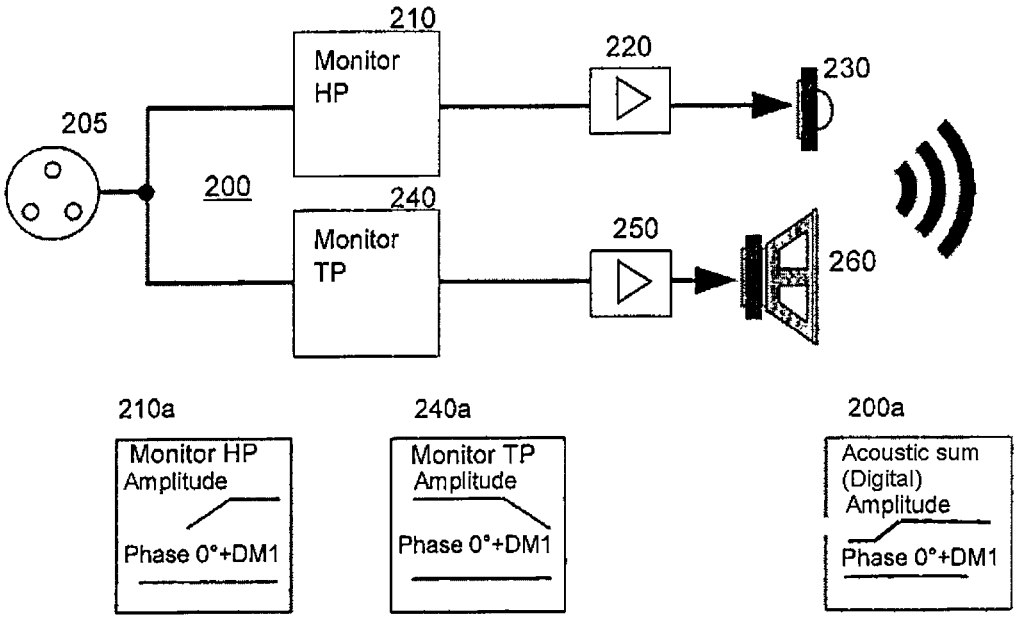
FIG. 2 shows a known digitally controlled two-way box.
Figure 4:
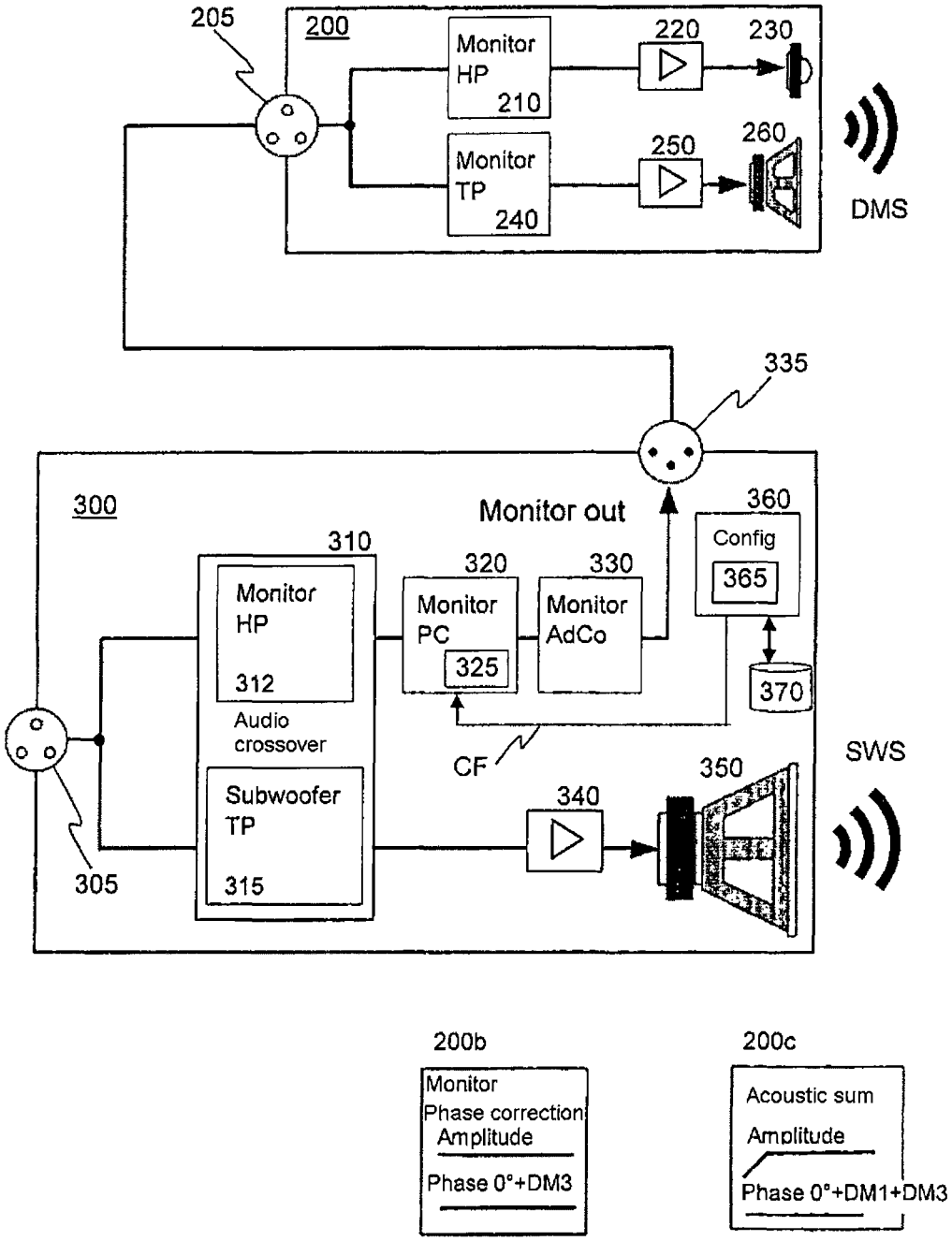
FIG. 4 shows a subwoofer according to the invention with a control unit and a digitally controlled two-way box connected thereto.

FIG. 4 shows a subwoofer according to the invention with a control unit 300 and a digitally controlled two-way box connected thereto. In this case, the control unit 300 only differs from that shown in FIG. 3 by different configuration data CF or a different configuration of the filter 320. As a result of the above-described phase-linear characteristic of digital loudspeaker boxes according to FIG. 2, the configurable filter 320 does not need to compensate for its phase response. The configurable filter 320 then has a frequency response 200*b* according to which is conducts the signal with a constant amplitude wherein the phase is 0° and an additional adjustable delay DM3 is optionally added via a delay member 325. For the series circuit of the configurable filter 320 with the loudspeaker box 200, a frequency response 200*c* is thereby obtained. This corresponds to the frequency response 200*a* wherein however the adjustable delay DM3 is added to the delay DM1 of the digital loudspeaker box 200.

The reproduction of the higher-frequency sound signal DMS by the digital loudspeaker box 200 is therefore accomplished overall with a delay which is composed of DM2+DM3+DM1, wherein DM2 is the delay of the high-pass branch 312 of the audio crossover 310 unchanged. For the correct audio reproduction of the audio system it must necessarily hold that DS=DM2+DM3+DM1. According to the invention, the configurable filter 320 can thus be configured by the configuration data so that this equation is satisfied individually for each connected digital loudspeaker box 200 if the configuration data thereof is stored in the memory 370. In addition, again as described for FIG. 3, a matching of DM3 to the spatial conditions of the installation site can be made.

In one embodiment, the memory 370 contains at least first and second configuration information corresponding to first and second type information for two different loudspeaker boxes, wherein the first type information relates to a first loudspeaker 100 which has an analogue signal processing and wherein the second type information relates to another second externally connectable or connected loudspeaker 200 with digital signal processing.

In one embodiment, the configurable filter 320, if it is configured according to the first configuration information CF for an analogue loudspeaker box 100, performs a phase correction of the high-pass component of the input audio data which compensates for a phase response of the analogue loudspeaker 100. On the other hand, the configurable filter 320 processes the high-pass component of the input audio data in a phase-linear manner if it is configured according to the second configuration information for a digital loudspeaker box 200.

Figure 5:
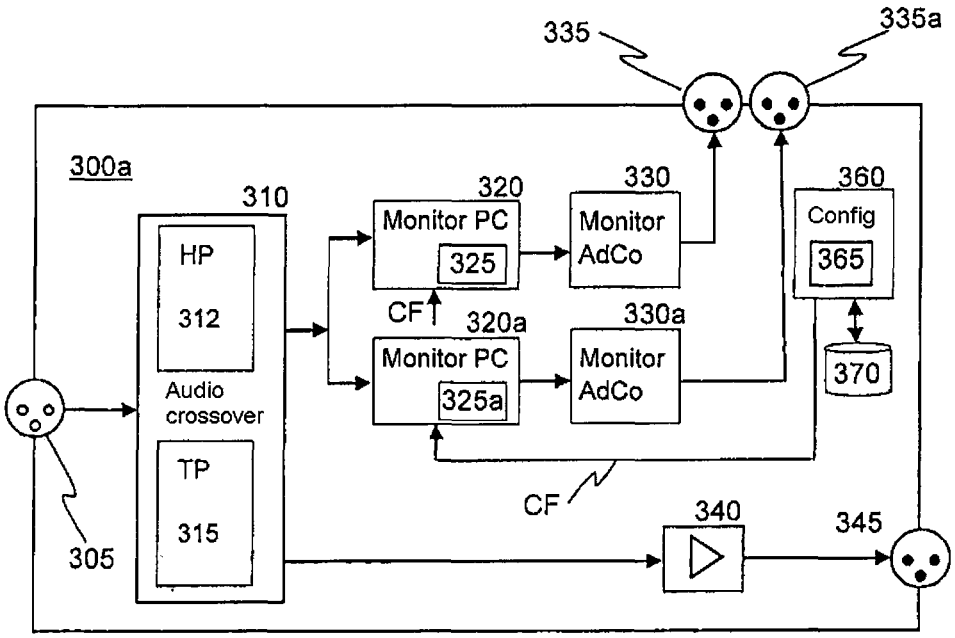
FIG. 5 shows a control unit according to the invention in a second embodiment and FIG. 6 shows a flow diagram of a method according to the invention.

It is usual that an audio system contains more than one loudspeaker box as monitor. Thus, in a second embodiment, it is possible to connect at least two loudspeaker boxes to the control unit 300. FIG. 5 shows a control unit 300*a* according to the invention in the second embodiment. This contains two or more output connections 335, 335*a* which are controlled by means of separately configurable filters 320, 320*a*. Each of the output connections is controlled as described above.

In one embodiment a separately configurable delay member 325, 325*a* is also contained for each output connection 335, 335*a*. The delay members can then be configured so that the sound signals from one loudspeaker connected to a first connection 335 are incident at the listening point at the same time as the sound signals from a loudspeaker connected to a second connection 335*a* and from the subwoofer.

In one embodiment a separately configurable processing block or correction block 330, 330*a* is also contained for each output connection 335, 335*a*. This is suitable to perform additional signal corrections of the audio data output via the at least one output connection 335, 335*a*.

Figure 6:
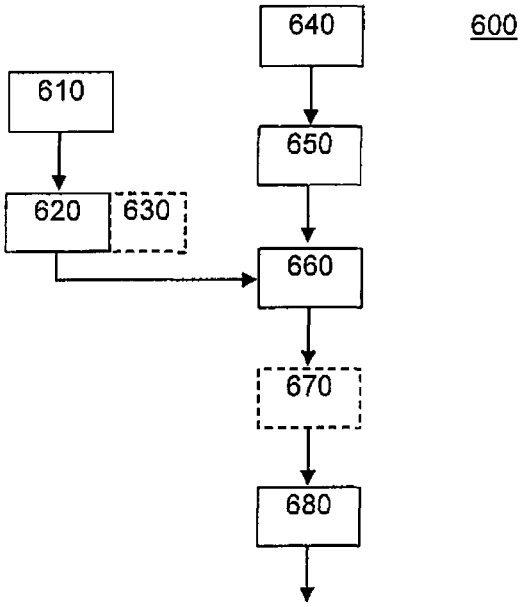

FIG. 6 shows a flow diagram of a method 600 according to the invention. In one embodiment a method 600 for phase correction of audio signals to be reproduced via several loudspeaker boxes comprises the steps:

- receiving (610) configuration data which pertain to a loudspeaker box (100, 200);
- configuring (620) a configurable filter (320) according to the received configuration data;
- splitting (640) audio data with an audio crossover (310) into at least one high-pass component and a low-pass component, wherein a high-pass branch (312) and a low-pass branch (315) of the audio crossover (310) each have individual delays and linear phase responses;
- reproducing (650) the low-pass component of the input audio data by a low-frequency loudspeaker (350) with a first delay which at least corresponds to the delay of the low-pass branch (315) of the audio crossover (310);
- filtering (660) the high-pass component of the input audio data with the configurable filter (320); and
- reproducing (680) the filtered high-pass component of the input audio data via the loudspeaker box (100, 200) with a second delay which at least corresponds to the delay of the high-pass branch (312) of the audio crossover (310), the configurable filter (320) and the loudspeaker box (100, 200), wherein the filtering (660) contains a phase correction when the loudspeaker box according to the configuration data has a nonlinear phase response and otherwise contains no phase correction.

In one embodiment, the method additionally contains the steps:

configuring (630) a configurable delay element (325) according to the configuration data, wherein the configurable delay element (325) is located upstream of, downstream of or in the configurable filter (32); and delaying (670) the high-pass component of the input audio data with the configurable delay element (325), wherein the second delay at least corresponds to the delay of the high-pass branch (312) of the audio crossover (310), of the configurable delay element (325) and of the loudspeaker box (100, 200) and wherein the configurable delay element (325) is configured in such a manner that the first and the second delay are equal or have a desired and defined temporal offset.

In one embodiment, the method additionally comprises the steps:

receiving second configuration data which pertain to a second loudspeaker box (200) with digital processing;

configuring a second configurable filter (320*a*) and a second configurable delay element (325*a*) according to the received configuration data, wherein the second configurable delay element (325*a*) is located upstream of, downstream of or in the second configurable filter (320*a*);

filtering the high-pass component of the input audio data with the second configurable filter (320*a*);

delaying the high-pass component of the input audio data with the second configurable delay element (325*a*); and reproducing the delayed high-pass component of the input audio data filtered with the second configurable filter (320*a*) via the second loudspeaker box (200) with a third delay, which at least corresponds to the delay of the high-pass branch (312) of the audio crossover (310), of the second configurable filter (320*a*), of the second delay element (325*a*) and of the second loudspeaker box (200), wherein the filtering with the second configurable filter (320*a*) contains no phase correction and wherein the second configurable delay element (325*a*) is configured in such a manner that the first, second and third delay are the same or have a desired and defined temporal offset.

Naturally, features of the various embodiments described above can be arbitrarily combined with one another insofar as this is appropriately possible.

The invention claimed is:

1. Control unit for an audio system comprising at least one subwoofer or low-frequency loudspeaker and at least one further loudspeaker, wherein the control unit comprises:

at least one input connection for receiving input audio signals;

at least one output connection for outputting audio signals to the at least one further loudspeaker;

at least one connection for outputting audio signals to the at least one subwoofer or low-frequency loudspeaker;

an audio crossover configured to split the input audio signals into at least one high-pass component and a low-pass component, wherein the low-pass component is output to the at least one subwoofer or low-frequency loudspeaker;

a configuration block comprising an input block and a memory, wherein the configuration block is configured to receive, via the input block, type information about the at least one further loudspeaker, and wherein the configuration block is configured to receive configuration information corresponding to the type information from the memory and output the configuration information; and a configurable filter, connected to the audio crossover, and configured to receive the configuration information from the configuration block, and to configure according to the configuration information, and to receive the high-pass component of the input audio signals, and to filter, according to the configuration information, the high-pass component of the input audio signals, and to output filtered audio signals to the at least one output connection.

2. The control unit according to claim 1, further comprising:

a configurable delay element for delaying the high-pass component of the input audio signals, wherein the configurable delay element is configured to receive the configuration information from the configuration block and adjust the delay according to the configuration information in such a manner that the filtered audio signals output via the further loudspeaker and the low-pass component of the input audio signals output via the at least one subwoofer or low-frequency loudspeaker can be output simultaneously or with a desired and defined time delay to one another.

3. The control unit according to claim 1, wherein the further loudspeaker is a first externally connectable or connected loudspeaker and comprises an analogue signal processing, wherein the memory contains at least first and second configuration information corresponding to first and second type information, and wherein the first type information relates to the first loudspeaker and the second type information relates to a second externally connectable or connected loudspeaker with digital signal processing.

4. The control unit according to claim 3, wherein the configurable filter, when configured according to the first configuration information, performs a phase correction of the high-pass component of the input audio signals, which compensates for a phase response of the first loudspeaker so that a series circuit of the configurable filter and the at least one further loudspeaker generates a phase-linear frequency response, and wherein the configurable filter, when configured according to the second configuration information, processes the high-pass component of the input audio signals in a phase-linear manner.

5. The control unit according to claim 3, wherein the at least one output connection is a first output connection and is provided for the first loudspeaker, and wherein when the configurable filter is configured according to the first configuration information, the control unit further comprises:

at least one second output connection for output of audio signals to a second external loudspeaker, which is connected via the second output connection; and at least one second configurable filter, connected to the audio crossover, configured to receive second configuration information from the configuration block and can be configured according to the second configuration information in order to receive the high-pass component of the input audio signals and to filter, according to the second configuration information, the high-pass component of the input audio signals wherein second filtered audio signals are obtained which are output to the at least one second output connection.

6. The control unit according to claim 5, wherein the configurable delay element is a first configurable delay element, wherein when the delay is adjusted according to the first configuration information, the control unit further comprises:

a second configurable delay element for delaying the high-pass component of the input audio signals, wherein the second configurable delay element is configured to receive the configuration information from the configuration block and adjust a delay according to the second configuration information in such a manner that the high-pass component of the input audio signals output via the first external loudspeaker, the filtered audio signals output via the second external loudspeaker and the low-pass component of the input audio data output via the at least one subwoofer or low-frequency loudspeaker are output simultaneously or with a desired and defined time delay to one another.

7. The control unit according to claim 1, further comprising:

at least one correction block for additional signal corrections of the audio signals output via the at least one output connection.

8. The control unit according to claim 1, wherein the input block comprises a network interface via which type information is received from the at least one further loudspeaker .

9. The control unit according to claim 1, wherein the input block comprises a user interface via which type information is received by user input.

10. The control unit according to claim 1, wherein the configuration information comprises at least filter parameters and delay values.

11. Subwoofer comprises a control unit according to claim 1, wherein the low-frequency loudspeaker is contained in the subwoofer.

12. Method for phase correction of audio signals to be reproduced via several loudspeaker boxes, the method comprising:

receiving configuration data which pertain to a loudspeaker box;

configuring a configurable filter according to the received configuration data;

splitting the audio signals with an audio crossover into at least one high-pass component and a low-pass component, wherein a high-pass branch and a low-pass branch of the audio crossover each have individual delays and linear phase responses;

reproducing the low-pass component of the audio signals by a low-frequency loudspeaker with a first delay including the delay of the low-pass branch of the audio crossover;

filtering the high-pass component of the audio signals with the configurable filter; and reproducing the filtered high-pass component of the audio signals via the loudspeaker box with a second delay including the delay of the high-pass branch of the audio crossover, wherein the filtering comprises a phase correction when the loudspeaker box, according to the configuration data, has a nonlinear phase response, and whereein the filtering comprises no phase correction when the loudspeaker box according to the configuration data, has a linear phase response.

13. The method according to claim 12, further comprising:

configuring a configurable delay element according to the configuration data, wherein the configurable delay element is located upstream of, downstream of or in the configurable filter; and delaying the high-pass component of the audio signals with the configurable delay element, wherein the second delay corresponds to the delay of the high-pass branch of the audio crossover, of the configurable delay element and of the loudspeaker box, and wherein the configurable delay element is configured in such a manner that the first and the second delay are equal or have a desired and defined temporal offset to one another.

14. The method according to claim 12, wherein the loudspeaker box is a first loudspeaker box with analogue signal processing and the filtering comprises a phase correction, comprising:

receiving second configuration data which pertain to a second loudspeaker box with digital processing;

configuring a second configurable filter and a second configurable delay element according to the received second configuration data, wherein the second configurable delay element is located upstream of, downstream of or in the second configurable filter;

filtering the high-pass component of the audio signals with the second configurable filter;

delaying the high-pass component of the audio signals with the second configurable delay element; and reproducing the delayed high-pass component of the audio signals, filtered with the second configurable filter, via the second loudspeaker box with a third delay, which includes the delay of the high-pass branch of the audio crossover, of the second configurable filter, of the second delay element and of the second loudspeaker box, wherein the filtering with the second configurable filter comprises no phase correction, and wherein the second configurable delay element is configured in such a manner that the first, second and third delay are the same or have a desired and defined temporal offset to each other.

15. Non-transitory computer readable medium with instructions, stored thereon, configured to be executed by a computer to carry out a method according to claim 12.

* * * * *